US006298849B1

(12) United States Patent
Scholey et al.

(10) Patent No.: US 6,298,849 B1
(45) Date of Patent: Oct. 9, 2001

(54) RESPIRATOR MASK WITH SNAP IN FILTER CARTRIDGE

(75) Inventors: Michael Forbes Scholey, Pacoima; Terry L. Grimsley, Lomita, both of CA (US)

(73) Assignee: Moldex-Metric, Inc.

( * ) Notice: Subject to any disclaimer, the term of this patent is extended or adjusted under 35 U.S.C. 154(b) by 0 days.

(21) Appl. No.: 09/417,580

(22) Filed: Oct. 14, 1999

(51) Int. Cl.[7] ..... A62B 7/10
(52) U.S. Cl. ..... 128/205.27; 128/206.17
(58) Field of Search ..... 128/205.27, 205.25, 128/206.12, 206.16, 206.17, 206.21, 206.27, 206.28, 206.15, 201.23, 201.24, 202.27; 2/206.61, 6.2, 454

(56) References Cited

U.S. PATENT DOCUMENTS

| | | | | |
|---|---|---|---|---|
| 2,668,532 | * | 2/1954 | Evans | 128/206.17 |
| 5,062,421 | * | 11/1991 | Burns et al. | 128/205.27 |
| 5,148,803 | * | 9/1992 | Schlobohm | 128/205.27 |
| 5,181,507 | * | 1/1993 | Michel et al. | 128/201.25 |
| 5,505,197 | * | 4/1996 | Scholey | 128/206.17 |
| 5,579,761 | * | 12/1996 | Yuschak et al. | 128/206.17 |
| 6,016,804 | * | 1/2000 | Gleason et al. | 128/206.17 |
| 6,044,842 | * | 4/2000 | Pereira et al. | 128/202.27 |
| 6,062,221 | * | 5/2000 | Brostrom et al. | 128/206.27 |
| 6,176,239 | * | 1/2001 | Grove et al. | 128/206.24 |
| 6,216,693 | * | 4/2001 | Rekow et al. | 128/205.27 |

* cited by examiner

*Primary Examiner*—John G. Weiss
*Assistant Examiner*—Teena K Mitchell
(74) *Attorney, Agent, or Firm*—Charles H. Schwartz

(57) ABSTRACT

A respirator mask, including a body member of a thin rigid plastic material and having an inner surface conforming to the face of a user. The body member includes as an inner surface and at least one opening to receive a filter cartridge. A first over-molded member is formed of a flexible, rubber-like material and is over-molded on the inner surface of the body member to form an over-molded inner surface to fit and seal upon the face of the user. A second over-molded member is formed of a flexible rubber-like material and is over-molded within the at least one opening for receiving a filter cartridge. The second over-molded member includes at least one flange member extending inwardly around the cartridge opening and is flexible from a first position to seal to a cartridge member and to a second position to allow the cartridge member to pass through the flange and then return to the first position to lock the cartridge member within the cartridge opening. A cartridge member includes at least one sealing flange formed of a substantially rigid material and has a shape substantially complementary to the internally extending flange portion of the second over-molded member. The flange portion of the cartridge member is larger in diameter than the diameter of the flange portion of the second over-molded member to have the flange portion of the filter cartridge, when pushed against the flange portion of the second over-molded member distorting the flange portion of the second over-molded member to allow the flange portion of the filter cartridge passing through and being locked and sealed in position by the return of the flange portion of the second over-molded member to its original position.

10 Claims, 2 Drawing Sheets

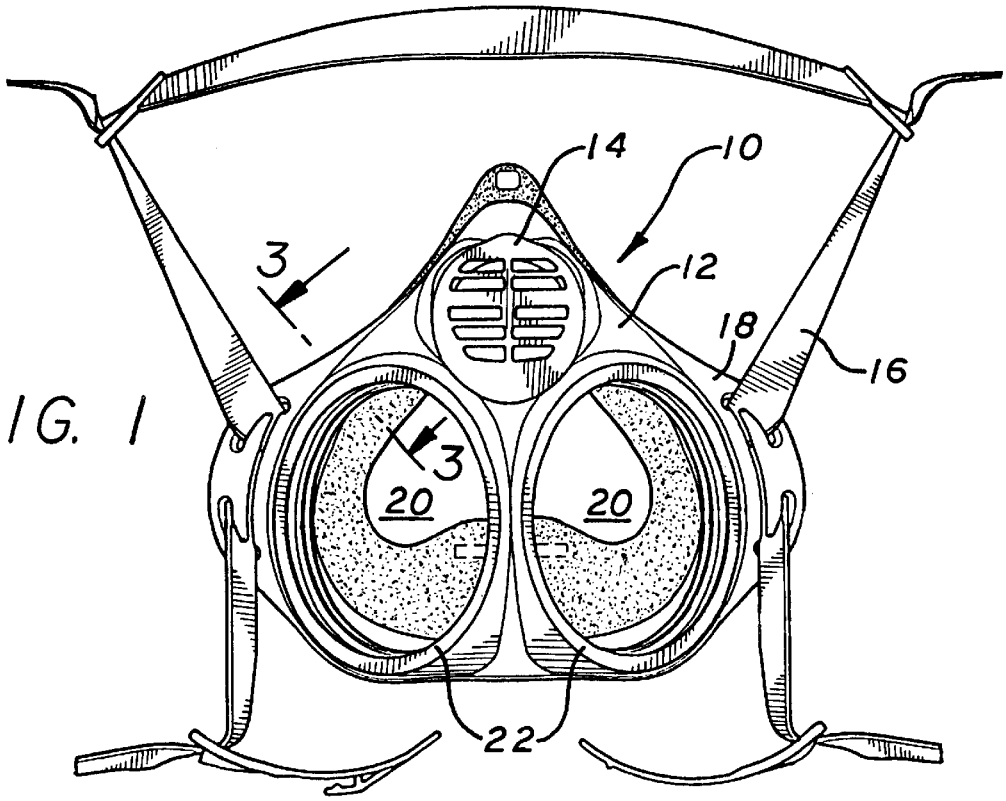
FIG. 1
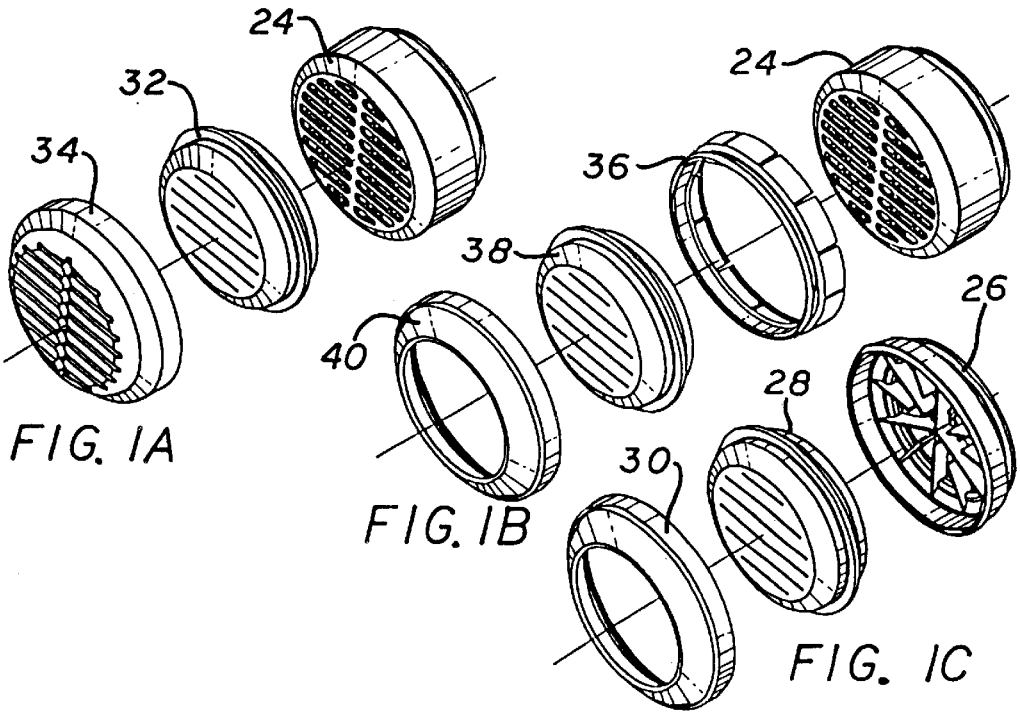
FIG. 1A
FIG. 1B
FIG. 1C

RESPIRATOR MASK WITH SNAP IN FILTER CARTRIDGE

THE BACKGROUND OF THE INVENTION

The present invention relates to a respirator mask and specifically to a respirator mask with includes replaceable cartridges.

In the prior art respirator masks have been made with replaceable cartridges. These respirator masks normally include cartridges being replaceable by either a screw on joint, using threaded connections or using a bayonet type joint between the cartridge and the mask. In these prior art devices it is often difficult to replace the cartridge since the threads may misalign or the bayonet joint may be difficult to engage. In addition in the prior art, if the cartridge is not either threaded on properly or connected properly using the bayonet joint, the mask may allow for the leakage of outside, unfiltered air into the mask. It is sometimes difficult to tell if the cartridge has been properly seated into a mask, which as indicated above, can allow for a dangerous situation of the mask allowing in unfiltered air.

The prior art masks are also relatively expensive to manufacture since the threaded connections must be accurately dimensioned and the bayonet joint must also be accurately dimensioned to ensure a proper seal.

In order to overcome the deficiencies of the prior art respirator masks as indicated above, a prior invention, now the subject of U.S. Pat. No. 5,505,197 and assigned to the same assignee as the instant invention, provided for a respirator mask which uses replaceable cartridges, but does not incorporate any threaded connection or a bayonet joint to have the cartridge attached to the mask. Specifically, in U.S. Pat. No. 5,505,197 the cartridge is attached to the mask using a simple groove around an interior inner end of the cartridge which mates with a complementary opening having a flange portion which is received in the groove inner end of the cartridge.

In the prior invention the mask body is made of a resilient, flexible rubber-like material and the flange portion around the opening itself acts as a joint member in cooperation with the groove to have the cartridge simply attached to the mask using this combination flange/groove construction. Since the mask is made of a flexible resilient material, the flange provides for an airtight seal between the cartridge and the mask.

Because of the specific groove and flange structure and the resiliency of the mask body itself, it is simple to install a cartridge by inserting the cartridge on an angle to engage the flange in one portion of the groove and then by merely stretching the resilient mask body around the opening the remaining groove portion seats into place to produce the proper sealing of the cartridge to the mask.

The difficulty with this type of design is that the mask body, being made of the resilient flexible rubber-like material is quite heavy and it would be desirable to replace the mask body with a thin rigid member, which is strong but yet much lighter in weight.

SUMMARY OF THE PRESENT INVENTION

The present invention is directed to a respiratory mask, which uses replaceable cartridges, but with the mask body or respirator shell molded from a relatively hard or rigid plastic material. Over molded to the outer edge of the mask body is a flexible, rubber-like material to provide for sealing of the mask body to the face of a user. In addition, the mask body includes at least one opening for receiving a filter cartridge and with a flexible, rubber-like material over molded within this, at least one cartridge opening, to receive the filter cartridge.

Specifically, the present invention uses a filter cartridge essentially of the same type shown in U.S. Pat. No. 5,505,197, but with the over molded rubber-like material surrounding the interior portion of the opening forming a cartridge opening designed to receive the filter cartridge and to have the filter cartridge fixed into position by snapping the filter cartridge into the cartridge opening.

In particular, the rubber-like material over molded within the cartridge opening includes a pair of flange members which extend into the cartridge opening and form inner and outer sealing members. The outer sealing member engages a tapered sealing surface in the filter cartridge and with the inner sealing member projecting downward to capture a flange portion of the filter cartridge. This provides for a snap-in cartridge, which is locked into position and additionally, sealed by the inner sealing member once the cartridge is fully seated into the cartridge opening.

BRIEF DESCRIPTION OF THE DRAWINGS

FIG. 1 is a front elevational view of the respirator mask of the present invention, FIGS. 1A, 1B, and 1C are exploded views of a plurality of filter cartridges or cartridge assemblies that can be used with the mask of FIG. 1.

DETAILED DESCRIPTION OF THE DRAWINGS

Figure 2:
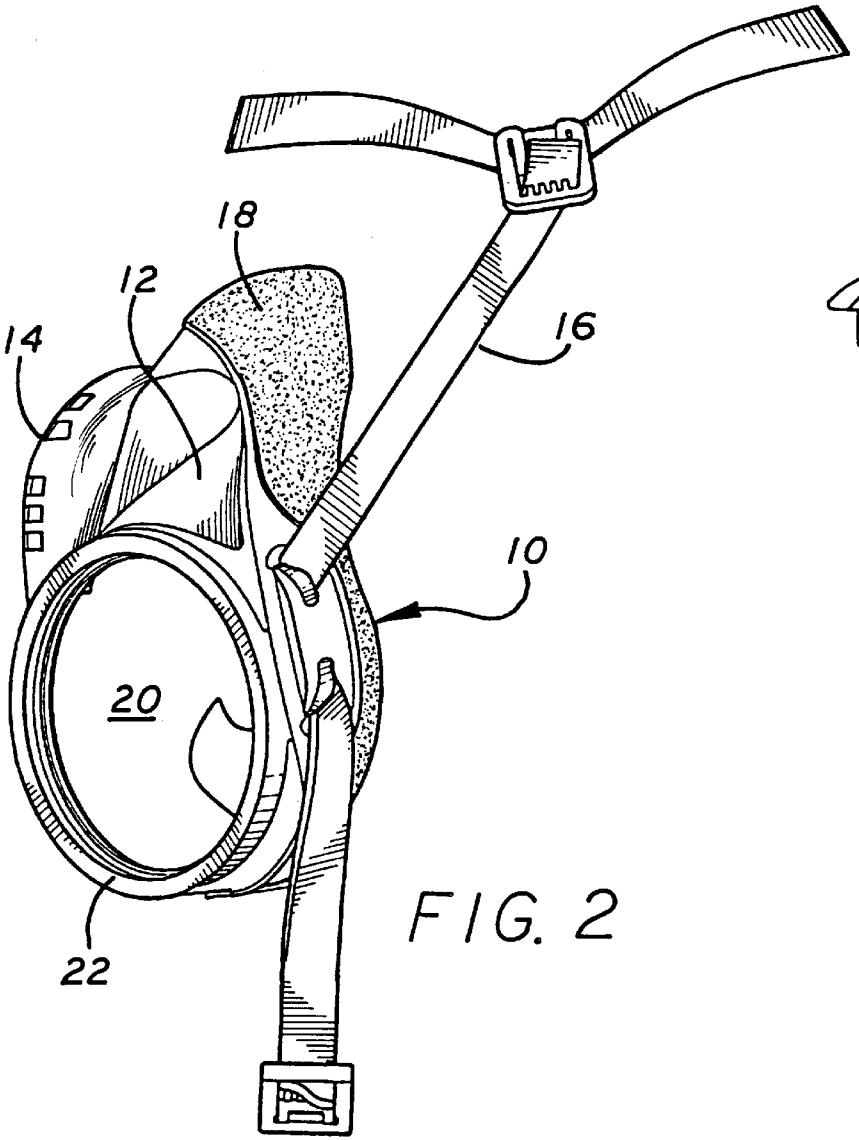
FIG. 2 is a side elevational view of the respirator mask of FIG. 1.

As shown in FIGS. 1 and 2, a mask is constructed in accordance with the teachings of the present invention and includes a rigid body portion 12, an exhalation valve 14 and a strap harness 16 for supporting the mask on the face of a user.

The mask body 12 is a unitary molded member of a thin rigid plastic and has over-molded portions 18 arranged around the inner face area of the mask to form a rubber-like flange member for supporting and sealing the mask to the face of the user.

The mask body 12 also includes a pair of cartridge openings 20 and additionally includes over-molded rubber-like flange members 22 located within the cartridge opening 20 to receive and seal cartridges within the cartridge openings. As shown in FIGS. 1A, 1B and 1C, individual filter cartridges 24 may be positioned within the openings 20 or cartridge assembly members 26 (one of which is shown in FIG. 1C) may be positioned within the cartridge openings 20. The filter cartridges 24 are complete cartridges in themselves, whereas the filter assembly members 26 requires additional members such as a replaceable filter member 28 and a cover member 30 to form a total filter assembly.

In addition, as shown in FIGS. 1A and 1B other types of additional filter members may be placed over the filter cartridge 24 such as a filter cartridge 32 and a cover member 34 to provide additional filter capacity or a coupling member 36 followed by a cartridge 38 and cover member 40 to again provide additional filtering capability to the cartridge 24. The cartridges 28, 32 and 38 may be of the same physical configuration, but have differing types of filter capabilities depending upon the internal construction. The covers 30 and 40 may be of the same physical configuration and the cover 34 is of a somewhat different configuration.

It can be seen, therefore, that it is possible to mix and match a variety of filter cartridges or cartridge assemblies to provide for differing levels of filtering capability and this type of interchangeable structure allows for great flexibility in the use of the filter mask of the present invention.

Figure 3:
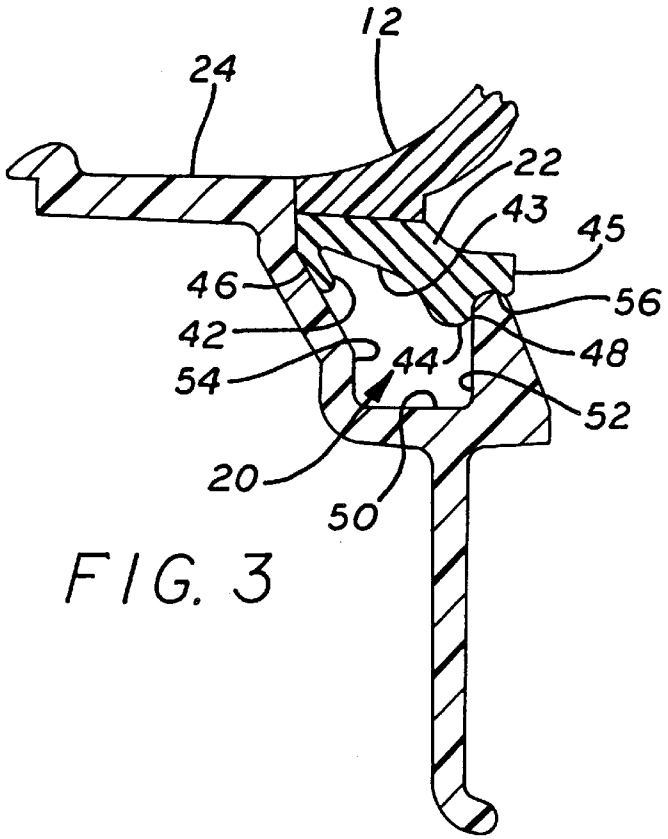
FIG. 3 is a cross-sectional view taken along lines 3—3 of FIG. 1 and with one of the cartridges or cartridge assemblies in position within the cartridge opening.

FIG. 3 illustrates a cross-sectional view of the filter mask taken along lines 3—3 of FIG. 1 and includes the complementary structure of the filter cartridge 24 taken along lines 3—3 of FIG. 1B or cartridge assembly member 26 taken along lines 3—3 of FIG. 1C. As shown in FIG. 3 the mask body 12 is formed as a shell of rigid plastic material and has the over-molded rubber-like flexible material 22 bonded to the inner surface of the opening 20. The over-molded portion 22 includes an outer flange member 42 and a inner flange member 44 interconnected by an insection ramp 43 and followed by a retention ring 45. These two flange members 42 and 44 provide for two sealing surfaces 46 and 48 when used in combination with the filter cartridge 24 or cartridge assembly member 26.

It should be noted that the filter cartridge 24 has substantially the identical structure shown in prior U.S. Pat. No. 5,505,197 and include a groove 50 formed by a front wall 52 and a back tapered wall 54. As can been seen in FIG. 3, the front and back walls 52 and 54 are complementary to the flanges 42 and 44 of the over-molded portion 22 located within the cartridge opening 20. As can be seen in FIG. 3, when the cartridge is snapped into position within the cartridge opening 20 the back wall 54 which is tapered engages the flange 42 which is relatively thin and flange 42 is then distorted to also have a tapered shape to conform to and seal to the back wall 54 and thereby provide for the first sealing surface 46.

Again as the cartridge 24 is snapped in position past the flange 44 front wall 52, which has a rounded upper end 56 distorts the flange 44 upward to override the flange 44. This provides for the front wall 52 and, specifically the rounded upper end 56 to engage and lock the cartridge in position behind the flange 44 and provide for a second sealing surface 48.

In actual operation as the cartridge member and specifically the front wall 52 is pushed into the cartridge opening 20, the rounded upper end 56 passes through the outer flange 42, slides down the insertion ramp 43, to engage the flange 44. The flange 44 is distorted to allow the upper rounded end 56 to pass through and behind the flange 44 to lock the cartridge into the position shown in FIG. 3. The flange 44 and retention ring 45 holds the cartridge in place and also holds the cartridge in a central position within the cartridge opening 20.

The advantages of the present invention over the prior art and, in particular, the prior U.S. Pat. No. 5,505,197 is that the present invention includes a mask body made of a rigid light plastic material and with only the heavier rubber-like material used to provide a sealing flange to the face and for sealing structures within the cartridge openings. This greatly reduces the weight and thereby increases the comfort of the mask when in use. Moreover the specific structure of the over-molded portions located within the cartridge openings 20 allows for the cartridge to be easily inserted into position by merely pushing the cartridge inwardly until the cartridge snaps into position.

It is very easy to determine that the cartridge is properly seated. It can be clearly seen if the cartridge is not completely seated since spacing between the cartridge and the cartridge opening 20 would be visible. It is also easy to replace the cartridge by pulling the cartridge outward. This in turn distorts the flange portion 44 and allows the rounded upper portion 56 of the front wall 52 to slide by the now distorted flange portion 44 so that the cartridge can be removed from the cartridge opening 20. The cartridge is thereby removed by providing sufficient force to overcome the various bending forces in the flexible material 22. The amount of absolute pullout for a maybe varied by the hardness of the soft material 22 and/or the diameters of the respective member 22 and 24.

By providing for a double sealing this provides for two completely different sealing surfaces and eliminates any leakage around the outside of the cartridge. The present invention thereby provides for a very simple assembly between cartridges and mask and additionally allows for the removal and replacement of the cartridges in a simple, fail safe operation by the user of the mask.

Although the invention has been described with reference to a particular embodiment, it is to be appreciated that various adaptations and modifications may be made and the invention is only to be limited by the appended claims.

What is claimed is:

1. A respirator mask, including a body member of a thin, rigid plastic material and having an inner surface conforming to a face of a user, the body member including an inner surface and at least one opening to receive a filter cartridge, a first over-molded member, formed of a flexible, rubber-like material and over-molded on the inner surface of the body member to form an over-molded inner surface to fit and seal upon a face of a user, a second over-molded member formed of a flexible rubber-like material and over-molded within the at least one opening for receiving a filter cartridge and with the second over-molded member, including at least one flange member extending inwardly around the cartridge opening and flexible from a first position to seal to a cartridge member to a second position to allow the cartridge member to pass through and then return to the first position to lock the cartridge member within the cartridge opening, a cartridge member including at least one outwardly extending flange formed of a substantially rigid material having a shape substantially complementary to the internally extending flange portion of the second over-molded member and with the outwardly extending flange portion of the cartridge member being larger in diameter than the diameter of the inwardly extending flange portion of the second over-molded member to have the flange portion of the filter cartridge, when pushed against the flange portion of the second over-molded member distorting the flange portion of the second over-molded member to allow the flange portion of the filter cartridge to pass through and be locked and sealed in position by the return of the flange portion of the second over-molded member to its original position.

2. The respirator mask of claim 1, additionally including a second inwardly extending flange portion of the second over-molded member, extending into the filter opening and with the filter cartridge including a second surface for engaging the second flange portion to provide a second seal between the filter cartridge and the second over-molded member.

3. The respirator mask of claim 2, wherein the second surface for engaging the second flange portion is tapered and with the tapered surface distorting the second flange portion of the second over-molded member to conform to the shape of the second surface.

4. The respirator mask of claim 1 wherein the filter member is a complete filter cartridge.

5. The respirator mask of claim 1 wherein the filter member is a filter assembly portion for receiving an interchangeable cartridge member.

6. A respirator mask, including a body member of a thin, rigid plastic material, the body member including an inner surface and at least one opening to receive a filter cartridge, a first member, formed of a flexible, rubber-like material and attached to the inner surface of the body member to fit and seal upon a face of a user, a second member formed of a flexible rubber-like material and attached within the at least one opening for receiving a filter cartridge and with the second member, including at least one flexible flange member extending inwardly around the cartridge opening, a cartridge member including at least one sealing flange formed of a substantially rigid material having a shape substantially complementary to the internally extending flange portion of the second member located and with the flange portion of the cartridge member being larger in diameter than the diameter of the flange portion of the second member to have the flange portion of the filter cartridge, when pushed against the flange portion of the second member distorting the flange portion of the second member to allow the flange portion of the filter cartridge to pass through and be locked and sealed in position by the return of the flange portion of the second member to its original position.

7. The respirator mask of claim 6, additionally including a second forwardly extending flange portion of the second member, extending into the filter opening and with the filter cartridge including a second surface for engaging the second flange portion to provide a second seal between the filter cartridge and the second member.

8. The respirator mask of claim 7, wherein the second surface for engaging the second flange portion is tapered and with the tapered surface distorting the second flange portion of the second member to conform to the shape of the second surface.

9. The respirator mask of claim 6 wherein the filter member is a complete filter cartridge.

10. The respirator mask of claim 6 wherein the filter member is a filter assembly portion for receiving an interchangeable cartridge member.

* * * * *